US009067408B2

(12) United States Patent
Veis

(10) Patent No.: US 9,067,408 B2
(45) **Date of Patent: *Jun. 30, 2015**

(54) PRINTING MEDIA SUPPORTABLE ON MOVABLE PALLETS

(75) Inventor: Alex Veis, Netanya (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 31 days.

This patent is subject to a terminal disclaimer.

(21) Appl. No.: 13/699,171

(22) PCT Filed: Feb. 10, 2011

(86) PCT No.: PCT/US2011/024372

§ 371 (c)(1),
(2), (4) Date: Mar. 11, 2013

(87) PCT Pub. No.: WO2012/108870

PCT Pub. Date: Aug. 16, 2012

(65) Prior Publication Data

US 2013/0170928 A1 Jul. 4, 2013

(51) Int. Cl.

| | |
|---|---|
| ***B41J 13/00*** | (2006.01) |
| ***B41J 13/10*** | (2006.01) |
| ***B41F 21/00*** | (2006.01) |
| ***B41J 11/06*** | (2006.01) |
| ***B41J 13/16*** | (2006.01) |

(52) U.S. Cl.

CPC ..... *B41F 21/00* (2013.01); *B41J 13/0072* (2013.01); *B41J 11/06* (2013.01); *B41J 13/16* (2013.01)

(58) Field of Classification Search

CPC ..... B41J 13/0027; B41J 13/10; B41J 13/24; B41J 13/0072; B41J 11/001; B65G 17/48; B65G 17/16; B61B 13/122

USPC ..... 400/48; 101/474; 198/465.1, 465.3, 198/867.01, 799

See application file for complete search history.

(56) References Cited

U.S. PATENT DOCUMENTS

| | | | | |
|---|---|---|---|---|
| 4,031,825 | A | 6/1977 | Jaffa | |
| 4,264,004 | A | 4/1981 | Harwick | |
| 4,383,605 | A | 5/1983 | Harwick | |
| 4,946,298 | A | 8/1990 | Oka et al. | |
| 5,009,306 | A | 4/1991 | Roderick et al. | |
| 6,068,209 | A | 5/2000 | Nakamura | |
| 6,293,387 | B1 | 9/2001 | Forster | |
| 6,640,958 | B2 * | 11/2003 | Postlmayr | 198/321 |
| 6,652,088 | B1 | 11/2003 | Palmer et al. | |

(Continued)

FOREIGN PATENT DOCUMENTS

| | | | | |
|---|---|---|---|---|
| DE | 19847249 A1 * | 4/2000 | ..... | B65G 17/46 |
| KR | 1020090044459 | 7/2009 | | |

OTHER PUBLICATIONS

Ranky, MagneMotion's linear synchronous motor (LSM) driven assembly automation and material handling system designs, Assembly Automation The International journal of assembly technology and management, vol. 27, No. 2, 2007, pp. 96-102.

*Primary Examiner* — Daniel J Colilla

(57) ABSTRACT

A media transport assembly includes a plurality of pallets arranged to circulate on an endless track through a print zone and a handling zone. In the print zone, the pallets are temporarily grouped together to support and move a print media during printing at a substantially constant velocity. In the handling zone, the pallets are spaced apart from each other as they circulate back to the print zone without supporting any print media.

13 Claims, 15 Drawing Sheets

(56) References Cited

U.S. PATENT DOCUMENTS

| | | | | |
|---|---|---|---|---|
| 6,731,898 | B1 | 5/2004 | Landa et al. | |
| 2001/0030111 | A1* | 10/2001 | Bethke et al. | 198/793 |
| 2001/0045970 | A1 | 11/2001 | Burikov et al. | |
| 2002/0007789 | A1 | 1/2002 | Doyle et al. | |
| 2003/0230941 | A1* | 12/2003 | Jacobs | 310/12 |
| 2007/0127832 | A1 | 6/2007 | Baumann et al. | |
| 2008/0192075 | A1 | 8/2008 | Campion et al. | |
| 2009/0276084 | A1 | 11/2009 | Pandit et al. | |

* cited by examiner

PRINTING MEDIA SUPPORTABLE ON MOVABLE PALLETS

CROSS-REFERENCE TO RELATED APPLICATION

This Utility Patent Application is a U.S. National Stage filing under 35 U.S.C. §371 of PCT/US11/24372, filed Feb. 10, 2011, published Aug. 16, 2012 as WO 2012/108870 A1 incorporated by reference herein.

BACKGROUND

In some large scale printers, loading and unloading media can present additional challenges. For example, in some instances, it can take longer to load and unload media from the printer than it does to actually print on the media. This inefficiency can be present even with automated or semi-automated loading systems. Moreover, some systems that use conventional belt-type conveyors present other challenges, such as a high implementation cost because of complicated motion control systems used to achieve accurate motion of media relative to printheads, among other issues. Meanwhile, some conventional systems also have difficulty in adequately securing irregular shaped media, such as curled media, during printing.

DETAILED DESCRIPTION

Figure 1:
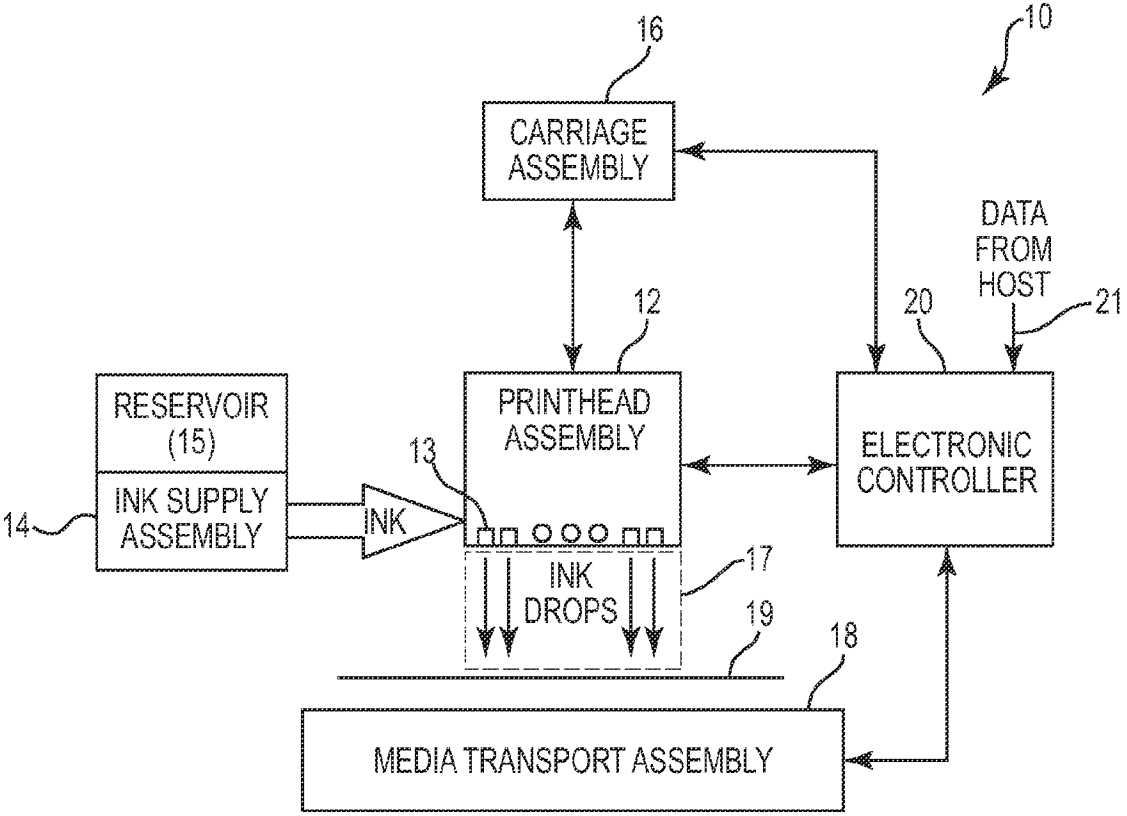
FIG. 1 is a block diagram of a printing system, according to an embodiment of the present disclosure.

In the following detailed description, reference is made to the accompanying drawings which form a part hereof, and in which is shown by way of illustration specific embodiments in which the present disclosure may be practiced. In this regard, directional terminology, such as "top," "bottom," "front," "back," "leading," "trailing," etc., is used with reference to the orientation of the Figure(s) being described. Because components of embodiments of the present disclosure can be positioned in a number of different orientations, the directional terminology is used for purposes of illustration and is in no way limiting. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

Embodiments of the present disclosure are directed to a media transport assembly of a printing system. In some embodiments, the printing system includes an array of pallets and an endless track or path on which the pallets circulate through a print zone and a handling zone. In the print zone, some of the pallets are arranged immediately adjacent each other as they move along the track and together these pallets temporarily form a group that supports and moves print media. The handling zone includes a load portion, an unload portion, and a return portion. The load portion is configured to receive, prior to the print zone, the print media onto a respective one of the circulating pallets while the unload portion is configured to release, after the print zone, the print media off a respective one of the circulating pallets. The return portion is configured to transport the pallets along the track from the unload portion to the load portion.

In this arrangement, the pallets traveling in the print zone form a virtual table on which print media is supported and carried relative to a printing mechanism. While the velocity of each pallet is controlled independently, the group of pallets in the print zone effectively travels together as a unit. With this arrangement, the pallets are able to move on a low-friction basis, which in turn, eases precise control of the velocity of the print media in the print zone.

In some embodiments, the print media is manually loaded and unloaded relative to the print zone. However, in other embodiments, the loading portion and the unloading portion operate to automatically load and unload, respectively, the print media relative to the print zone, thereby substantially increasing throughput of the printing system. In some embodiments, the automatic loading and unloading takes place simultaneously, and in some embodiments, the automatic loading, automatic unloading, and printing all occur simultaneously.

Embodiments of the present disclosure include a drive mechanism for controlling movement of the pallets about the endless track. In one embodiment, the endless track includes a linear motor (or array of such linear motors) including, among other things, an array of electromagnetic elements while each pallet includes a magnetic element that is operably coupled to the linear motor. In one aspect, a velocity of each pallet is directly controlled by the linear motor interacting with the magnetic element residing on each pallet. With this arrangement, the pallets move in a low friction manner along the track while being under precise velocity control. Because the linear motor is common to the separate pallets, the arrangement enables each pallet to be controlled independently from each other while simultaneously enabling multiple pallets (such as those forming a virtual table supporting a print media) to move in unison for a period of time.

In other embodiments, a conveying system is used to propel the pallets and to control the position and velocity of the pallets along the track through the print zone and the handling zone in a manner substantially the same as described above, except without using linear motors. In some embodiments, the conveying system includes belt-drive components for supporting and moving the pallets, while in other embodiments, the conveying system includes pneumatic control components for controlling movement of the pallets.

In one embodiment, a method of transporting print media sheets includes grouping together sheet-supporting pallets at or before a print zone and carrying a single print media sheet through the print zone on the group of pallets. After the print zone, the pallets are ungrouped. The acts of grouping, carrying, and ungrouping are repeated endlessly throughout a printing operation to enable high throughput printing. In one embodiment, the endlessly repeating acts of grouping, carrying, and ungrouping occur along a track that includes the print zone.

While these embodiments are applicable to wide range of sizes and types of print media, these embodiments are especially suited to transporting and printing upon large scale print media, which can be rigid or flexible. These embodiments are also well-suited to print media, which exhibits irregular shapes prior to and/or during printing, such as corrugated print media (e.g. corrugated carton sheets). In addition, because the loading portion of the handling zone facilitates automatic loading of print media (onto the virtual table of pallets) into in the print zone and because the unloading portion of the handling zone facilitates automatic unloading of print media away from the print zone, embodiments of the present disclosure allow much faster throughput than conventional large scale printers, which typically utilize manual or semi-automatic loading and unloading schemes.

These embodiments, and additional embodiments, are described and illustrated in association with FIGS. 1-13.

FIG. 1 illustrates a printing system 10 in accordance with one embodiment of the present disclosure. Printing system 10 includes a printhead assembly 12, an ink supply assembly 14, a carriage assembly 16, a media transport assembly 18, and an electronic controller 20. Printhead assembly 12 includes one or more printheads which eject drops of ink through orifices or nozzles 13 and toward a print media 19 so as to print onto print media 19. In one embodiment, printhead assembly 12 includes inkjet printheads, such as thermal inkjet printheads while in other embodiment, printhead assembly 12 includes other types of printhead, such as but not limited to, piezoelectric printheads.

Print media 19 is any type of suitable sheet material, such as paper, card stock, plastics, and the like. In some embodiments, print media 19 is rigid or substantially rigid while in other embodiments, print media 19 is flexible. In some embodiments, print media 19 is substantially larger than a sheet of paper with sizes on the order of 2 or 3 feet by 4 to 5 feet. However, it will be understood that smaller or larger sizes can be used. Furthermore, in some instances, print media includes some undulating or irregular-shaped portions, which such shapes being present prior to printing and/or arising during printing (in the case of some corrugated materials).

Typically, nozzles 13 of printhead assembly 12 are arranged in one or more columns or arrays such that properly sequenced ejection of ink from nozzles 13 causes characters, symbols, and/or other graphics or images to be printed upon print media 19 as printhead assembly 12 and print media 19 are moved relative to each other.

Ink supply assembly 14 supplies ink to printhead assembly 12 and includes a reservoir 15 for storing ink. As such, ink flows from reservoir 15 to printhead assembly 12. In one embodiment, printhead assembly 12 and ink supply assembly 14 are housed together in an inkjet cartridge or pen. In some embodiments, ink supply assembly 14 is separate from printhead assembly 12 but still directly communicates ink to the printhead assembly 12 via a releasable connection with the ink supply assembly 14. This embodiment is sometimes referred to as an on-axis configuration of the ink supply assembly 14. However, in other embodiments, the ink supply assembly 14 is positioned remotely from the printhead assembly 12, with the ink supply assembly 14 communicating ink to the printhead assembly 12 via an array of supply tubes. This embodiment is sometimes referred to as an off-axis configuration of the ink supply assembly 14.

Carriage assembly 16 positions printhead assembly 12 relative to media transport assembly 18 and media transport assembly 18 positions print media 19 relative to printhead assembly 12. Thus, a print zone 17 is defined adjacent to nozzles 13 in an area between printhead assembly 12 and print media 19. In one embodiment, printhead assembly 12 is a non-scanning type printhead assembly. As such, carriage assembly 16 fixes printhead assembly 12 at a prescribed position relative to media transport assembly 18. Thus, media transport assembly 18 advances or positions print media 19 relative to printhead assembly 12.

Electronic controller 20 communicates with printhead assembly 12, media transport assembly 18, and, in one embodiment, carriage assembly 16. Electronic controller 20 receives data 21 from a host system, such as a computer, and includes memory for temporarily storing data 21. Typically, data 21 is sent to printing system 10 along an electronic, infrared, optical or other information transfer path. Data 21 represents, for example, an image, a document, and/or file to be printed. As such, data 21 forms a print job for printing system 10 and includes one or more print job commands and/or command parameters.

In one embodiment, electronic controller 20 provides control of printhead assembly 12 including timing control for ejection of ink drops from nozzles 13. As such, electronic controller 20 operates on data 21 to define a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on printhead assembly 12. In another embodiment, logic and drive circuitry is located remotely from printhead assembly 12.

Figure 2A:
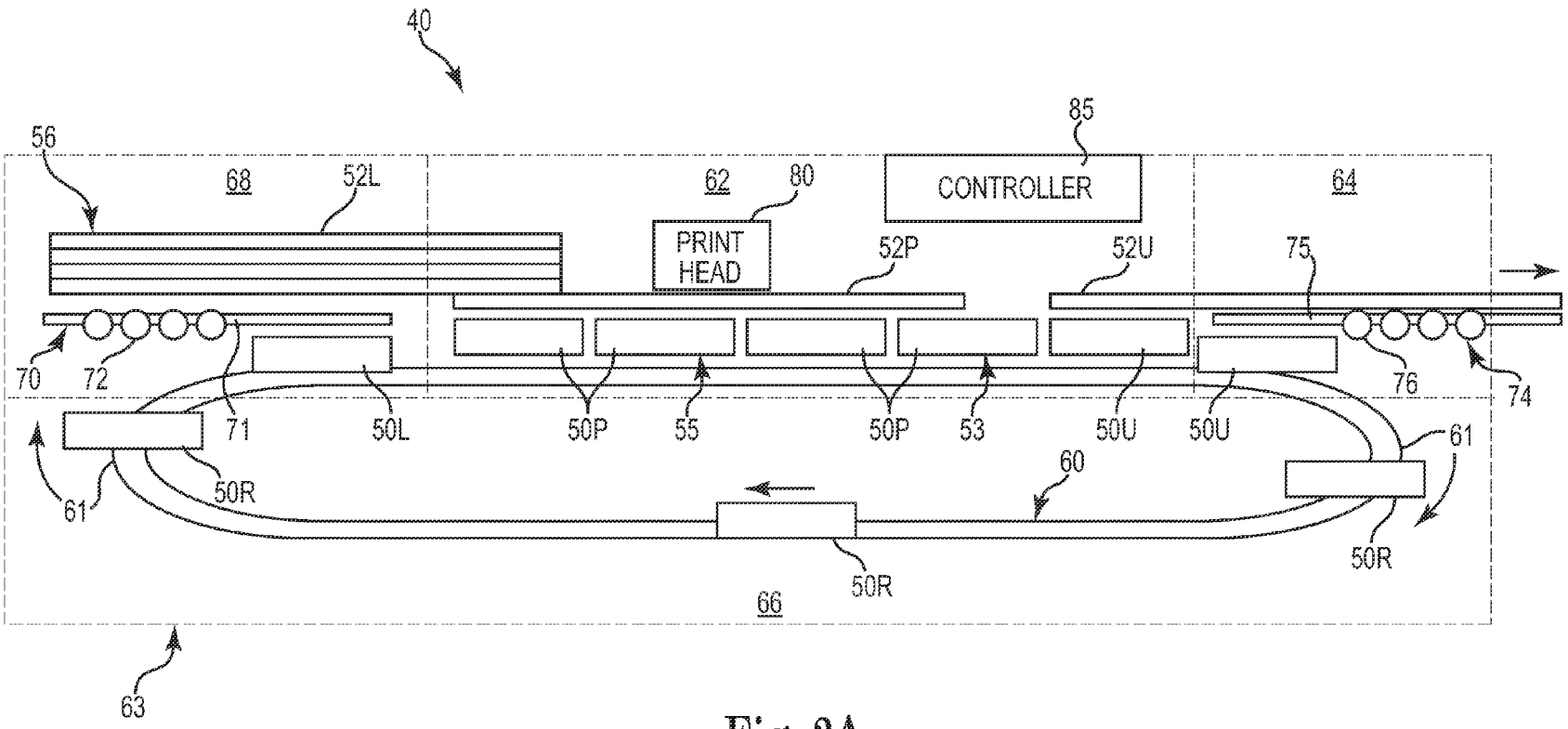
FIG. 2A is a side view schematically illustrating a media transport assembly of a printer, according to an embodiment of the present disclosure.

FIG. 2A is a side view schematically illustrating a media transport assembly 40 of a printing system, according to an embodiment of the present disclosure. In one embodiment, media transport assembly 40 includes at least substantially the same features and attributes as media transport assembly 18 and printing system 10, as previously described in association with FIG. 1.

As shown in FIG. 2A, in one embodiment media transport assembly 40 comprises an array 53 of pallets 50 arranged to circulate endlessly on a track 60 through a print zone 62 and a handling zone 63. The handling zone 63 includes an unloading zone 64, a return zone 66, and a loading zone 68. While the pallets in array 53 are generally identical, as shown in FIG. 2A the various pallets carry a designation corresponding to their current position along track 60 relative to the respective print and handling zones 62, 63. Accordingly, pallets currently in the print zone are represented by reference numeral 50P while pallets in the handling zone are presented by reference numerals 50U (corresponding to the unloading portion 64), 50R (corresponding to the return portion 66), and 50L (corresponding to the loading portion 68). In this way, FIG. 2A informs those skilled in the art regarding the particular function of a respective pallet 50 according to its position along track 60 at a particular snapshot in time.

Moreover, while FIG. 2A depicts pallet 50R in a region 61 of track 60 of having pivoted relative to track 60 in a manner that maintains a generally horizontal orientation of pallet 50R despite the vertically downward and curved orientation of track in region 61, it will be understood that FIG. 2A is just a schematic representation depicting the relationship of pallet 50R relative to track 60 in a handling zone 63. Accordingly, it will be understood that the particular orientation of pallet 50R (whether horizontal or vertical or some other orientation) relative to track 60 is not limiting to the operation of media transport assembly 40 and that the particular orientation of a pallet 50R relative to track 60 will depend on the particular manner of mechanically coupling pallet 50R relative to track 60, some of which are further described and illustrated below in association with at least FIGS. 2B-2G.

As further illustrated in FIG. 2A, in some embodiments, media transport assembly 40 includes a loading mechanism 70 configured to hold a stack 56 of print media 52 and to automatically offload individual print media 52L one-at-a-time via platform 71 and rollers 72, in a manner to be described further below in association with at least FIG. 7. It will be understood that, in one embodiment, multiple print media 52 within a given print job have a generally identical size and/or shape while in other embodiments, multiple print media 52 within a given print job can vary in size and shape.

As shown in FIG. 2A the print media are labeled according to their relative position to printhead assembly 80. For example, a print media supported on pallets 50P and traveling underneath printhead assembly 80 is labeled as 52P, while print media being offloaded from pallets 50P and 50U is labeled as 52U. Meanwhile, print media being loaded onto pallets 50L and 50P is labeled as 52L. In one embodiment, printhead assembly 80 includes substantially the same features and attributes as printhead assembly 12, as previously described in association with FIG. 1.

In one aspect, pallets 50P in print zone 62 are located immediately adjacent each other to temporarily form a group 55 that supports and moves print media 52P. While the velocity of each pallet 50P is controlled independently, pallets 50P are also controlled collectively as a group within print zone 62 to maintain a substantially identical and substantially constant velocity of print media 52P through print zone 62. With this arrangement, group 55 of pallets 50P act as a virtual table to support print media 52P despite the independently controlled movement of each respective pallet 50P. In some embodiments in which print media 52P is relatively large, each pallet 50P is substantially smaller than a single print media 52P such that 3-5 pallets form a group 55 large enough to support the single print media 52P. Of course, in other embodiments, it will be understood that a smaller (e.g. 2) or larger (e.g. 6 or more) number of pallets 50P can be used to temporarily form a group 55 defining a virtual table, depending upon the size of the pallets and/or the size of the print media 52P. Accordingly, the virtual table (formed by a group of pallets) is variable in size at the discretion of an operator of the printing system so that an appropriate sized table (one optimizes the throughput of the printing system) is selected depending upon the size and/of shape of the image to be printed on print media 52. To do so, in one embodiment the operator identifies the appropriate number of pallets to support the print media. Of course, in some embodiments, all or part of the selection of the number of pallets to achieve a target size of a virtual table is performed automatically via controller 85 that knows the size of the image.

As further shown in FIG. 2A, in some embodiments, media transport assembly 40 includes an unloading mechanism 74 within unloading portion 64, with unloading mechanism 74 configured to receive printed-upon print media 52U from unloading pallets 50U via platform 75 and rollers 76, thereby automatically removing the print media 52U from transport along pallets 50. As will be further described later, in some embodiments unloading mechanism 74 further automatically conveys or directs printed-upon print media 52U away from unloading zone 64, such as via a ramp. It will be understood that in some embodiments such unloading mechanisms can combine different elements, such as combining a ramp with the platform 75 or even using a ramp alone without employing the platform 75 and rollers 76.

In some embodiments, loading mechanism 70 and unloading mechanism 74 operate simultaneously with each other, and generally simultaneous with printing on media 52P on pallets 50P in the print zone. This arrangement provides a substantial increase in throughput over conventional printing systems.

As further shown in FIG. 2A, handling zone 63 includes a return portion 66 positioned between the unloading portion 64 and the loading portion 68. The return portion 66 conveys pallets 50R in their unloaded state from the unloading portion 64 to the loading portion 68. In one aspect, media transport assembly 40 operates to convey pallets 50R to travel at a substantially greater velocity than pallets 50P traveling in print zone 62 to maintain harmonious circulation of pallets 50 throughout track 60. In short, because pallets 50R do not support a print media 52, pallets 50R are free to move at a much higher velocity (through return portion 66 of handling zone) to expedite their return back to the print zone 62. However, upon entry of pallets within loading portion 68 of handling zone 63, a respective pallet 50L will experience a reduction in velocity as it approaches print zone 50P to allow automatic loading of print media onto a respective pallet 50L and to achieve the predetermined "print zone" velocity. Likewise, upon exiting print zone 62, pallets 50U traveling through unloading portion 64 of handling zone 63 experience an increase in velocity as they move toward and into return portion 66.

In some embodiments, a controller 85 supports and controls operation of media transport assembly 40 and printhead assembly 8 in a manner substantially the same as previously described for controller 20 (FIG. 1). For example, controller 85 controls the velocity of each pallet 50 along track 60 independently from the other pallets 50. As will be described in further detail, components of track 60 and/or pallets 50 are equipped to cooperate with controller 85 to enable precision control of the velocity of each individual pallet 50 as well as a group 55 of pallets 50, when aggregated together in print zone 62.

In one embodiment, controller 85 comprises one or more processing units and associated memories configured to generate control signals directing the operation of media transport assembly 40. In particular, in response to or based upon commands received via input from an operator or instructions sent to or contained in the memory of controller 85, the controller 85 generates signals to control operations of media transport assembly 40. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent, non-volatile, or non-transient storage. In other embodiments, hard wired circuitry may be used in place of or in combination with software instructions to implement the functions described. For example, controller 18 may be embodied as part of one or more application-specific integrated circuits (ASICs). Unless otherwise specifically noted, the controller is not limited to any specific combination of hardware circuitry and software, nor limited to any particular source for the instructions executed by the processing unit.

Figure 2B:
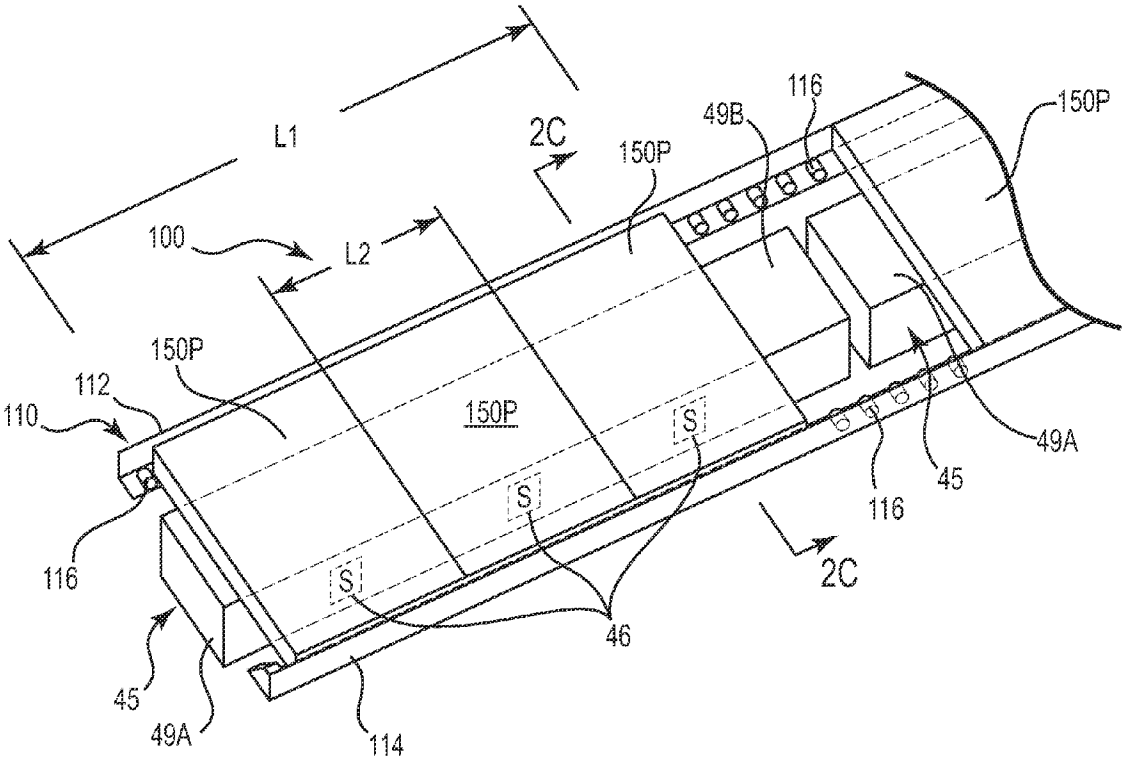
FIG. 2B is a perspective view schematically illustrating one segment including a track and pallet arrangement of a media transport assembly of a printer, according to an embodiment of the present disclosure.

While track 60 and pallets 50 can be arranged together in many configurations, FIG. 2B provides a perspective view schematically illustrating a media transport assembly 100 having a track 110 that supports and guides movement of pallets 150, according to one embodiment of the present disclosure. FIG. 2C is a sectional view taken along lines 2C-2C of FIG. 2B.

As shown in FIG. 2B, track 110 includes a pair of rails 112, 114 spaced apart and generally parallel to each other. As shown in FIGS. 2B-2C, in some embodiments, each rail 112, 114 comprises a horizontally extending ledge 120 and a vertically extending side wall 118 that supports rollers 116. Pallets 150P (so designated when in the print zone 62) have a size and shape that fits between opposite rails 112, 114 when lateral portions of pallets 150P are rollingly supported by rollers 116 of rails 112, 114. Pallets 150P are configured to support an object 190 (such as a print media like print media 52 in FIG. 2A) on a single pallet or across multiple pallets 150 (as shown in FIG. 2A). In one embodiment, pallets 50 (regardless of which zone in which they reside) include a magnetic element 157 secured onto or embedded within plate 151 of pallet 150. In one aspect, the magnetic element 157 is located at a bottom portion of the pallet 150. In another embodiment, the material forming plate 151 of pallet 150 incorporates magnetic material throughout the plate 151. In some embodiments, magnetic element 157 comprises a permanent magnetic material while, in other embodiments, magnetic element 157 comprises magnetically responsive material.

Transport assembly 100 also comprises a linear motor (LM) configured to control movement and position of pallets 150 relative to track 110. In one embodiment, linear synchronous motor (LM) comprises a series of separate LM units 45 arranged end-to-end along track 110, as shown in FIG. 2B, and which cooperate together to act as one continuous unit. Each linear synchronous motor (LM) element 45 includes a first end 49A, a second end 49B, and extends a length (L1). In some embodiments, the length (L1) of the LM unit 45 is substantially greater than a length (L2) of an individual pallet 150P, as shown in FIG. 2B. In one aspect, because LM unit 45 remains stationary along with rails 112, 114, in some embodiments, LM units 45 are considered to be part of the track 110.

In this arrangement, a bottom portion of each pallet 150P is spaced apart from a top portion of the LM unit 45 while lateral portions of the respective pallets 150P are rollingly supported via rollers 116 on rails 112, 114 of track 110. Accordingly, rails 112, 114 enable movement of each pallet 150P relative to track 110, while the LM units 45 exert control over the position of pallets 150P via controlling the initiation, velocity, and termination of movement of pallets 150P along track 110. Because the pallets 150P do not make contact with the LM units 45, a much greater efficiency is achieved due to a reduction in friction and greater accuracy in controlled velocity of the respective pallets 150P.

As further shown in FIG. 2C, each LM unit 45 includes an array of sensors 46, one or more permanent magnet elements 47, and control circuitry 48. As known to those skilled in the art, this arrangement enables precise control over starting, stopping, position, and/or velocity of devices (e.g. pallets 150P) magnetically responsive to LM unit 45. Moreover, the LM unit 45 is equipped to handle the starting, stopping, position, and/or velocity of multiple devices relative to a single LM unit 45. With multiple LM units 45 arranged end-to-end in series, control circuitry 48 enables coordinated movement of devices (e.g. pallets 150) along the series of LM units 45. In some embodiments, control circuitry 48 of each LM unit 45 is in operative communication with a master controller (such as controller 85 in FIG. 2A or controller 20 in FIG. 1) to coordinate regulation of the velocity and position of each pallet individually along track 110 (such as track 60). In one embodiment, each LM unit 45 comprises at least substantially the same features and attributes as a linear synchronous motor sold under the trademark QuickStick® and available from MagneMotion, Inc. of Devens, Mass.

While FIG. 2B depicts a track 110 including a pair of opposed rails 112, 114, it will be understood that in other embodiments, track 110 comprises a single rail arranged along LM units 45 and configured to guide pallets 150 along track 110.

In addition, with further reference to FIG. 2B, it will be understood that in one embodiment the magnetic element 157 of a respective one of the pallets 150 and the magnetic element 47 within track 110 (e.g. within a respective one of the LM units 45) comprise reciprocal first and second portions with one of the respective first and second portions comprising an electromagnetic element and the other of the respective first and second portions comprising a magnetically responsive material. Via controller 85 (FIG. 2A), electromagnetic control is exerted over the velocity of the pallets 150 relative to track 110.

Figure 2D:
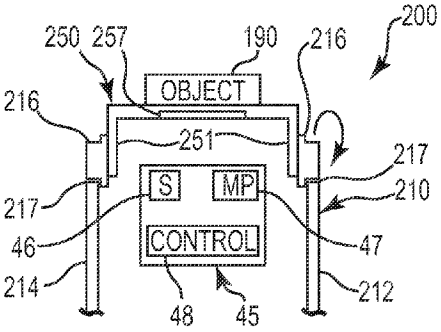
FIG. 2D is a sectional view schematically illustrating a track and pallet arrangement of a media transport assembly, according to an embodiment of the present disclosure.

In other embodiments, as shown in FIG. 2D, media transport assembly 200 includes substantially the same features and attributes as media transport assembly 100 (as illustrated in association with FIGS. 2B-2C), except reversing the location of wheels or rollers between the pallets 250 and track 210. In particular, track 210 is defined by a pair of opposed side walls 212, 214 while each pallet 250 includes legs 251 with each respective leg supporting a wheel or disc 216 that is configured to slide or roll along a top portion 217 of each side wall 212, 214. As in the prior embodiment (associated with FIG. 2C), a bottom portion of the pallet 250 is spaced apart from a top portion of LM unit 45 and the LM unit 45 controls a position and movement of the pallet 250 along track 210.

The embodiment of pallets 150 and track 110 depicted in FIG. 2C or pallets 250 and track 210 depicted in FIG. 2D provide for adequate constraint of pallets 150, 250 as they travel generally horizontally through a print zone 62 (shown in FIG. 2A) with gravity helping to maintain pallets 150, 250 on rollers 116, 216 respectively. However, to the extent that regions of a track (such as portion 61 or portion 65 in FIG. 2A) of a media transport assembly would cause the orientations of the pallets to extend generally vertical (in region 61) or to be vertically below rollers 116, 216 (such in region 65 of FIG. 2A), then further constraints are appropriate to retain pallets 150, 250 in a coupled relationship to track 60 and to LM units 45.

Figure 2G:
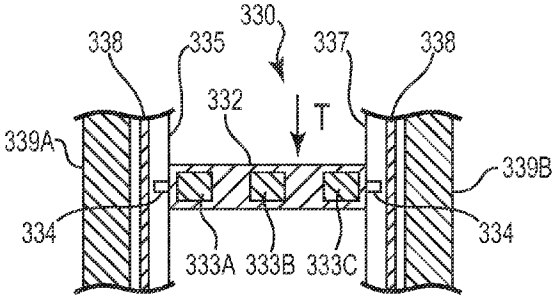
FIG. 2G is a sectional view as taken along lines 2G-2G of FIG. 2F schematically illustrating track and pallet portions of a media transport assembly, according to an embodiment of the present disclosure.
Figure 2F:
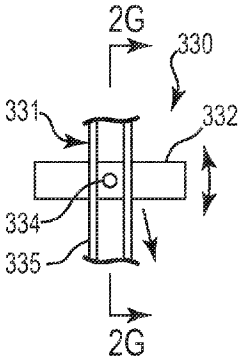
FIG. 2F is a side view schematically illustrating a track and pallet arrangement of a media transport assembly, according to an embodiment of the present disclosure.
Figure 2C:
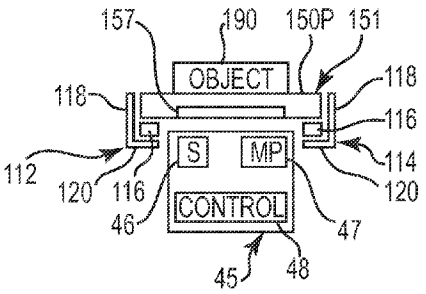
FIG. 2C is a sectional view as taken along lines 2C-2C of FIG. 2B schematically illustrating a track and pallet arrangement of a media transport assembly, according to an embodiment of the present disclosure.
Figure 2E:
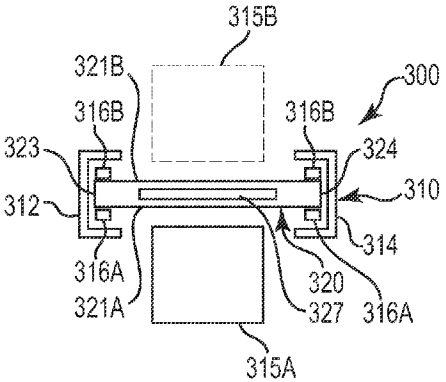
FIG. 2E is a sectional view schematically illustrating a track and pallet arrangement of a media transport assembly, according to an embodiment of the present disclosure.

With this situation in mind, in some embodiments, track 110 or 210 includes a modification to further mechanically constrain motion of the pallets 150, 250 relative to their respective tracks 110, 210 regardless of the particular orientation of the pallets 150, 250 relative to gravitational forces. Accordingly, FIG. 2E schematically illustrates a media transport assembly 300 that defines an arrangement of a track 310 and pallet 320 in which rails 312, 314 on opposite sides 323, 324 of pallet 320 are configured to cause pallet 320 to be interposed or sandwich between rollers 316A (on a first bottom side of pallet 320) and rollers 316B (on an opposite second top side of pallet 320). This arrangement ensures that pallet 320 remains operably coupled relative to track 310 along regions of track 310 where gravitational forces would otherwise cause separation of pallet 320 from track 310. Because pallets 320 passing through a print zone (such as print zone 62 in FIG. 2A) will support a print media, and because pallets 320 need not support a print media in the handling zone (such as handling zone 63 in FIG. 2A), in some embodiments the style of rails 312, 314 of FIG. 2E (and associated rollers 316A, 316B) is deployed solely in regions such as regions 61 and/or 65 (seen in FIG. 2A) to overcome the effect of gravitational forces on a pallet 320 where such further constraints (e.g. rails 312, 314) will not interfere will releasable support of print media on pallets 320.

As further shown in FIG. 2E, pallet 320 includes a centrally located magnetic element 327 so that pallet 320 will be responsive to a LM unit 315A is on a first side or to a LM unit 315B (when present) on a second opposite side of pallet 320. With this arrangement, pallet 320 is configured to be operably coupled to the available LM units 315A or 315B, regardless of which side of the pallet 320 that the LM unit 315A, 315B is positioned.

It will be understood by those skilled in the art that other arrangements of providing rolling or sliding movement of a pallet or flat relative to a track can be used while still employing LM units 45 to control the position and movement of the pallets 150 along the track 110. Accordingly, in just one example, FIGS. 2F-2G schematically illustrate another arrangement of a track and pallets of a media transport assembly 330, according to an embodiment of the present disclosure, in which a pallet 332 is allowed to pivot relative to track 331 such that the orientation of the pallet 332, at least in some regions (such as region 61 of track 60 in FIG. 2A), need not match the orientation of track 331 as the pallet travels through a handling zone (such as handling zone 63 in FIG. 2A). FIG. 2F is a side view of media transport assembly 330 that includes a track 331 with rails 335, 337 constraining movement of pallet 332 along track 331 (regardless of the orientation of track 331 relative to gravitational forces) while allowing rotation of pallet 332 via pin or pivot mechanism 334 relative to track 331. FIG. 2G is a sectional view as taken along lines 2G-2G of FIG. 2F and illustrates pins 334 (on opposite sides of pallet 332) arranged to move along rails 335, 337. Because pallet 332 can pivot relative to track 331 when the orientation of track 331 permits (such as in a handling zone 63 of FIG. 2A), LM units 339A, 339B are located laterally external to outer walls 338 of rails 335, 337 and are positioned to act on at least outer magnetic elements 333A, 333C of pallet 332, as shown in FIG. 2G. In one aspect, portions of track 331 are formed of material that is not magnetically responsive so as to not interfere with the operable coupling between LM units 339A, 339B and the magnetic elements 333A, 333C in pallet 332.

In this general arrangement shown in FIG. 2G, the LM units 339A, 339B are located so as to not interfere with pivoting of pallets 332 relative to track 331 with this arrangement being deployed in regions (such as region 61 in FIG. 2A) in which print media is not being supported by the pallets 332. In some embodiments, pallet 332 includes a centrally located magnetic element 333B positioned to be responsive to centrally located LM unit (such as LM unit 45 in FIG. 2B) when pallet 332 is in a print zone (such as print zone 62 in FIG. 2A).

It will be further understood that in other embodiments, a media transport assembly includes one or more drive mechanisms other than linear motors to cause the pallets to move along the endless track while precisely and independently controlling the velocity of each pallet to either temporarily form a virtual table in a print zone or to allow the pallets to travel in a spaced apart relationship. Another one of these embodiments is later described in more detail in association with FIGS. 12-13. In other examples, a drive mechanism for controlling a position and velocity of the pallets is provided via one or more an endless belt conveyor systems, arranged to move the pallets in an endless path including a print zone (in which the pallets are grouped together to travel as a virtual table) and a handling zone (in which the pallets travel spaced apart from each other).

Figure 3:
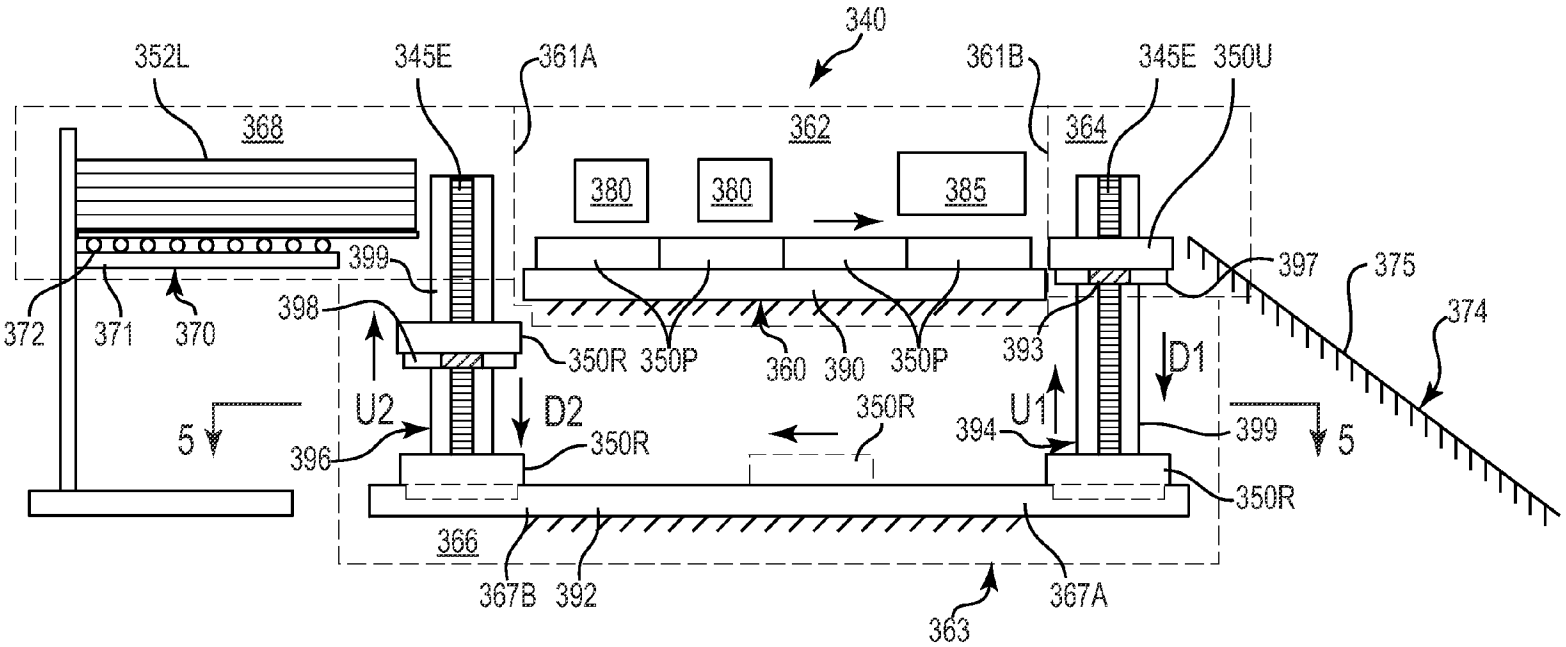
FIG. 3 is a side view schematically illustrating a media transport assembly, according to an embodiment of the present disclosure.

FIG. 3 is a side view of a printing system including a media transport assembly 300, according to an embodiment of the present disclosure. In one embodiment, FIG. 3 comprises substantially the same features and attributes as the media transport assemblies previously described in association with FIG. 1-2C, except for the variations on regarding the track and how pallets are guided along the track, which are described further below. In one embodiment, as shown in FIG. 3, media transport assembly 300 includes a print zone 362 and a handling zone 363, which includes an unloading portion 364, a return portion 366, and a loading portion 368. Pallets 350 move through the print zone 362 and handling zone 363 along a path or track 360. In one embodiment, track 360 is defined by table portion 390 in print zone 362 and by a table portion 392 in return portion 366 of handling zone 363. Elevators 392, 394 further define track 360 with first elevator 394 extending vertically between the unloading portion 364 (adjacent second end 361B of print zone 362) and a first end 367A of table portion 392 while second elevator 396 extends vertically between the second end 367B of table portion 392 and the loading portion 368 (adjacent first end 361A of print zone 362).

In one embodiment, each table portion 390, 392 incorporates LM units 345 which have substantially the same features as LM units 45, as previously described in association with FIG. 2B. It will be understood that the particular cross-hatched appearance of LM units 345 in FIGS. 3-10 is for illustrative purposes and does not represent an alteration in the composition of the LM units 345 relative to the composition of the LM units 45 in FIGS. 2B-2C.

In one embodiment, loading mechanism 370 with platform 371 and rollers 372 operates in substantially the same manner as loading mechanism 70 to cause automatic loading of print media onto pallets 350, as previously described in association with at least FIG. 2A.

With further reference to FIG. 3, each elevator 394, 396 includes a platform 397, 398, respectively, that is supported by and movable vertically along tower 399 of the respective elevators 394, 396. In some embodiments, the tower 399 of each elevator 394, 396 includes a LM unit 345E that controls the vertical position and movement of platform 397 or 398 relative to the tower 399. In one aspect, each platform 397, 398 also includes a magnetic element 393 that becomes operably coupled relative to LM unit 345E such that LM unit 345E extending vertically along tower 399 acts to control the position and movement of platforms 397,398. In a manner similar to the embodiments associated with FIGS. 2A-2G, a track mechanism of rails on tower 399 is provided by which platform 397,398 is slidably or rollingly supported and constrained relative to elevator tower 399 to guide movement of the respective platforms 397,398 vertically up and down.

With this arrangement in mind, following printing upon print media in print zone 362, platform 397 of elevator 394 receives print media and positions print media to be handled by unloading mechanism 374 in unloading portion 364. In one embodiment, unloading mechanism 374 comprises a ramp 375 adjacent elevator 394 and is positioned so that as print media 352 passes across the platform 397 of elevator 394, the print media 352 becomes positioned to slide down ramp 375 away from print zone 62 for further processing and/or collection.

Figure 4:
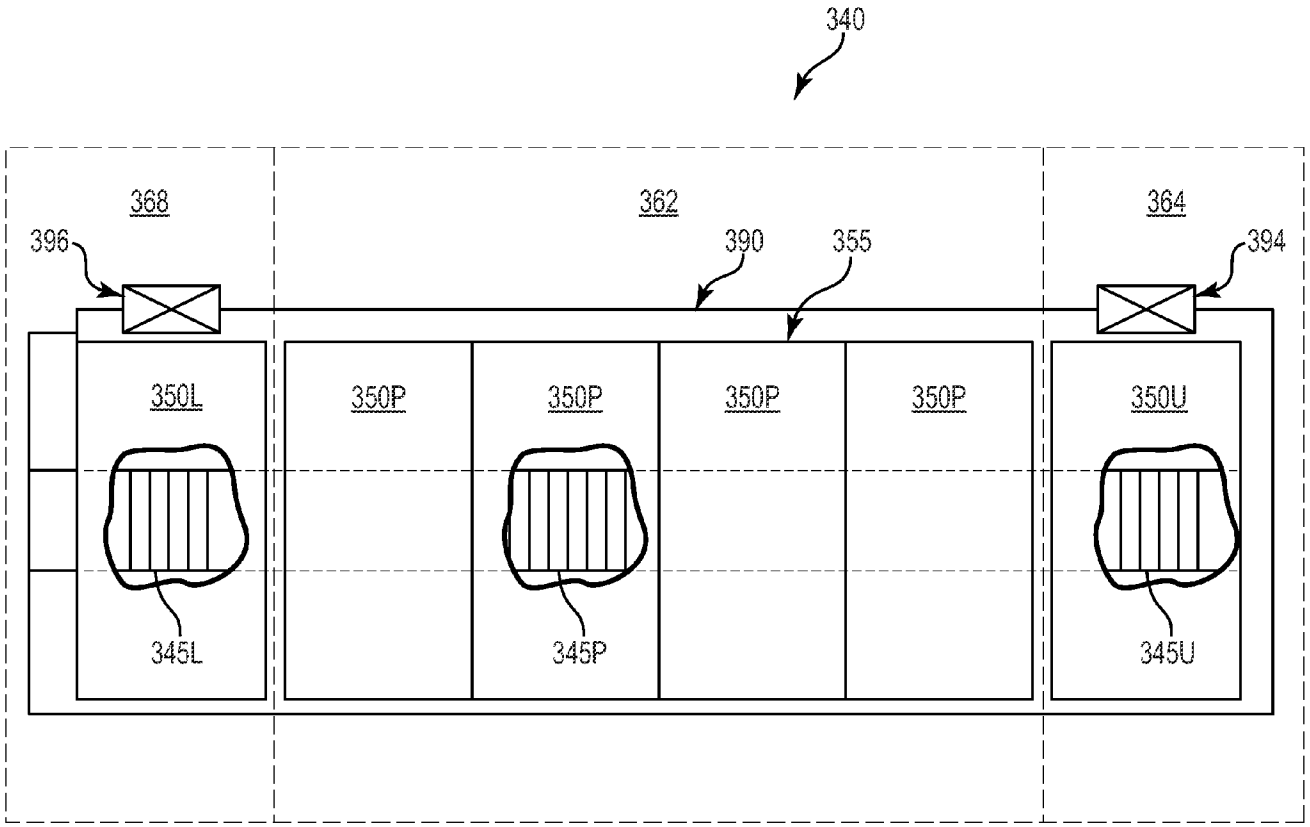
FIG. 4 is a partial top view schematically illustrating the media transport assembly of FIG. 3, according to an embodiment of the present disclosure.

Once free of print media 352, platform 397 of elevator 394 moves downward (represented by arrow D1) bringing pallet 350R to return portion 366 such that pallet 350R becomes aligned for travel along table portion 392. At this point, a LM unit 345U embedded into platform 397 of elevator 394 (as seen in FIG. 4) initiates propulsion of pallet 350R off platform 397 of elevator 394 and onto table portion 392 within return portion 366 of handling zone 363. Via LM unit 345R in table portion 392, pallet 350R is rapidly conveyed toward second elevator 396 and onto platform 398 of second elevator 396. As further shown in FIG. 4, LM unit 345L embedded in platform 398 of elevator 396 acts on pallet 350R to complete movement and positioning of pallet 350R onto platform 398 of second elevator 396. Meanwhile, platform 397 of elevator 394 (without any pallets thereon) is moved vertically upward (represented by arrow U1) to return to the unloading portion 364 to await receipt of the next printed-upon print media 352U.

With pallet 350R supported by platform 398 of second elevator 396, elevator 396 raises pallet 350R vertically (as represented by arrow U2), thereby conveying the pallet 350R up to the loading portion 368 of handling zone 363. At this location, print media 352L is advanced from loading mechanism 370 onto platform 398 of second elevator 396 such that LM unit 345L of platform 398 of second elevator 396 and the LM units 345P in table portion 390 of print zone 362 cause movement of print media 352L onto pallets 350P for support and movement relative to printhead assembly 312 through print zone 362.

After print media 352L is unloaded from platform 398 of second elevator 396 onto pallets 350P in print zone 362, platform 398 (without any pallet thereon) is moved vertically downward (as represented by D2) to return to a position adjacent second end 367B of table portion 392 (in return portion 366 of handling zone 363) to await receipt of the next pallet 350R.

FIG. 4 is a partial top view of media transport assembly schematically illustrating pallets 350P in print zone 362 (with printhead assembly 380 removed for illustrative purposes) with LM units 345P in table portion 390 underlying the transport path of pallets 350P, according to one embodiment of the present disclosure. In one aspect, as shown in FIG. 4, LM units 345P in table portion 390 extend along substantially the entire length of print zone 362 and underlie the group 355 of immediately adjacent pallets 350P to control movement of pallets 350P as a virtual table supporting a print media. In addition, each platform 397, 398 of elevators 394, 396 includes a LM unit 345U, 345L, respectively to assist in conveying pallets 350P on and off platform of elevators, in the manner described above.

Figure 5:
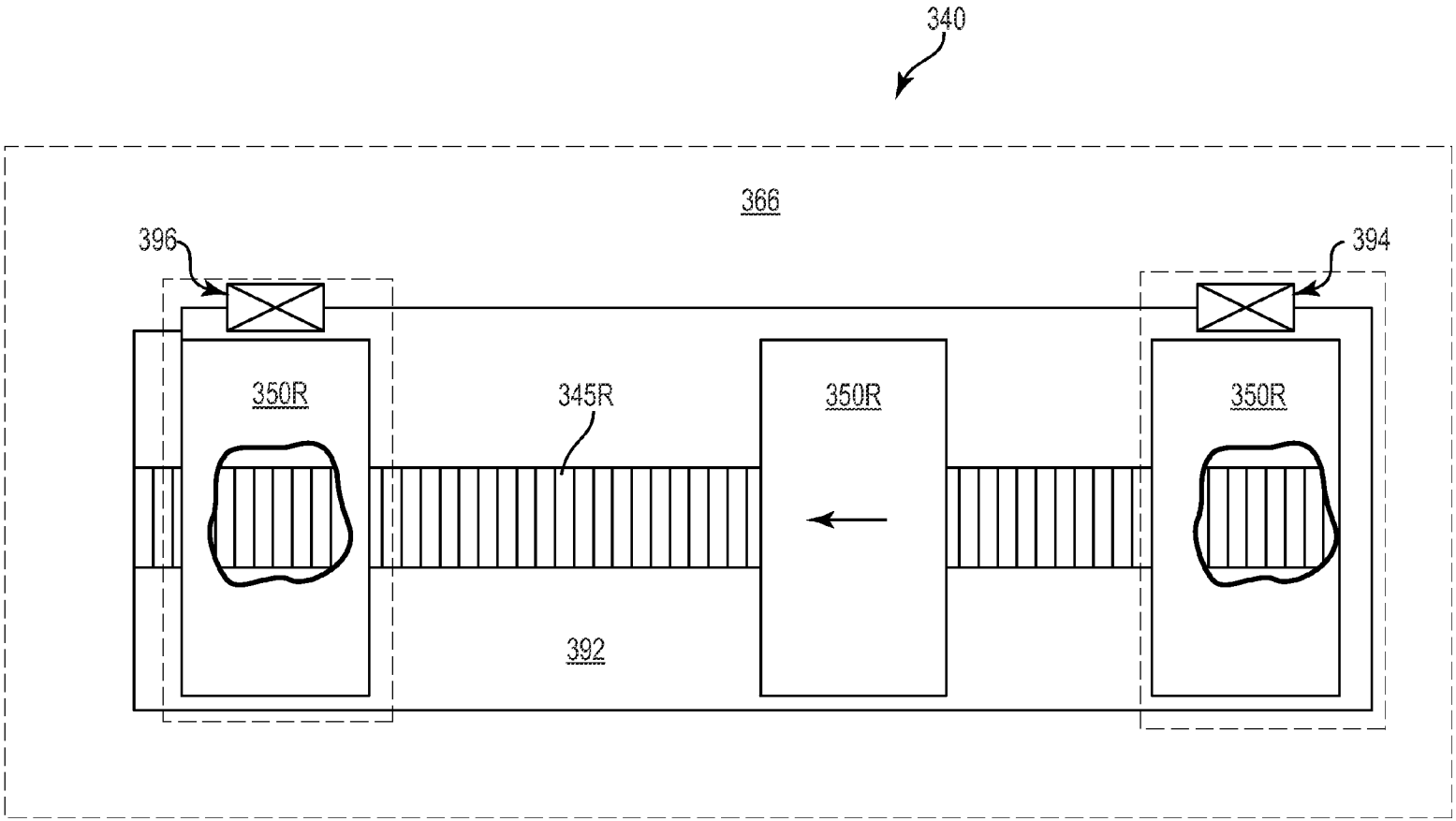
FIG. 5 is a view taken along lines 5-5 of FIG. 3 that schematically illustrates a lower portion of the media transport assembly, according to an embodiment of the present disclosure.

FIG. 5 is a partial view of media transport assembly as taken along lines 5-5 of FIG. 3 and schematically illustrating pallets 350R in return portion 366 with LM units 345R of table portion 392 underlying the transport path of pallets 350R, according to one embodiment of the present disclosure. In one aspect, as shown in FIG. 5, LM units 345R extend along substantially the entire length of table portion 392 (in return portion 366 of handling zone 363) and underlie the traveling pallet 350R control movement of pallet 350R. In addition, as previously noted in connection with FIG. 4, each platform 397, 398 of the respective elevators 394, 396 includes a LM unit 345U, 345L to assist in conveying pallets 350R on and off platform of elevators, in the manner described above.

Figure 6B:
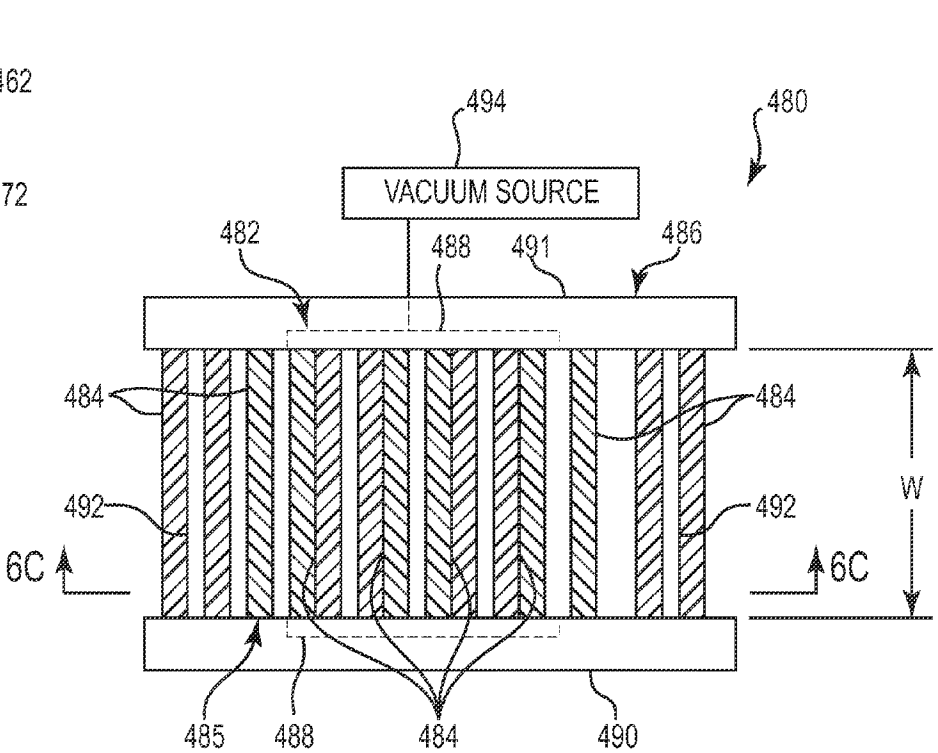
FIG. 6B is a top view schematically illustrating a vacuum system of a media transport assembly, according to an embodiment of the present disclosure.
Figure 6A:
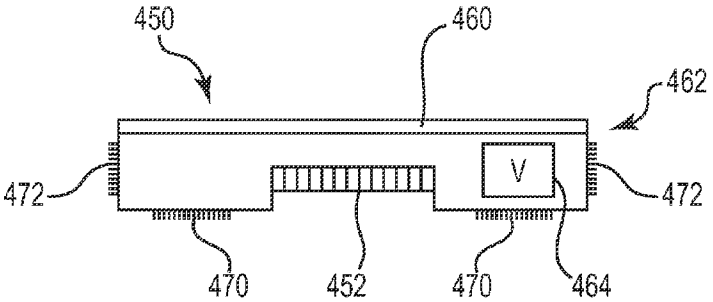
FIG. 6A is a side view schematically illustrating a pallet of a media transport assembly, according to an embodiment of the present disclosure.

FIG. 6A is a side view schematically illustrating a pallet 450, according to one embodiment of the present disclosure. In one embodiment, pallet includes generally the same features and attributes as pallets 50, 150, 250, or 320, as previously described in association with FIGS. 1-5. As shown in FIG. 6A, pallet 450 includes a magnet element 452, which comprises either a permanent magnet or magnetically responsive material. In addition, pallet 450 includes its own independent vacuum mechanism including a vacuum surface portion 460 located at a top portion 462 of pallet 450, and a vacuum source (V) 464 configured to apply negative pressure or vacuum at vacuum surface portion 460 to draw and removably secure a print media against and relative to the top portion 462 of pallet 450. In some embodiments, pallet 450 receives electrical power via bottom brushes 470 and/or side brushes which are configured to become electrically coupled to a conductive component of the track (e.g. track 110 in FIG. 2B, track 310 in FIG. 2E, etc.) of a media transport assembly.

Figure 6C:
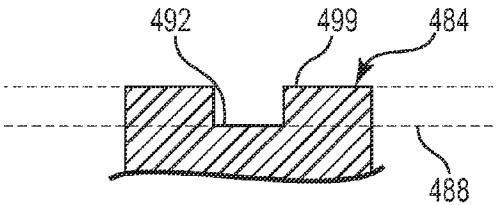
FIG. 6C is sectional view as taken along lines 6C-6C of FIG. 6B, according to an embodiment of the present disclosure.

However, in other embodiments, pallets of a media transport assembly include a vacuum mechanism in which the vacuum source is located remotely from the individual pallets. Accordingly, FIG. 6B is a top view schematically illustrating a vacuum mechanism 482 in association with pallets 484 in a print zone along a track of a media transport assembly 480, in accordance with one embodiment of the present disclosure. FIG. 6C is a sectional view of one pallet 484 of the assembly shown in FIG. 6B. As shown in FIG. 6B, a track 486 is provided for guiding and constraining movement of a group 485 of pallets 484 through a print zone. In one embodiment, track 486 includes a vacuum conduit 488 arranged on each opposite rail 490,491 of track 486 and each pallet 484 includes a vacuum recess 492 extending across a width (W) of the respective pallet 484. With this arrangement, when a vacuum is applied via vacuum source 494 at vacuum conduit 488 on rails 490, 491 of track 486, the vacuum also becomes applied throughout the vacuum recess 492 of each pallet 484. In this way, a vacuum force is present at a top surface 499 (FIG. 6C) of the group 485 of pallets 484 by virtue of the vacuum being applied at each pallet 484. The vacuum provided via pallets 484 is used to removably secure a print media on the group 485 of pallets 484 during advancement of the print media through a (e.g. print zone 362 in FIG. 3).

In this arrangement, each pallet 484 temporarily carries its own passive vacuum mechanism with the vacuum source located remotely from pallets 484. This arrangement conveniently keeps the construction of each pallet relatively simple because a vacuum source need not be provided on or routed through each pallet while still being able to apply a vacuum source at the top surface of the pallets in the print zone.

Figure 7:
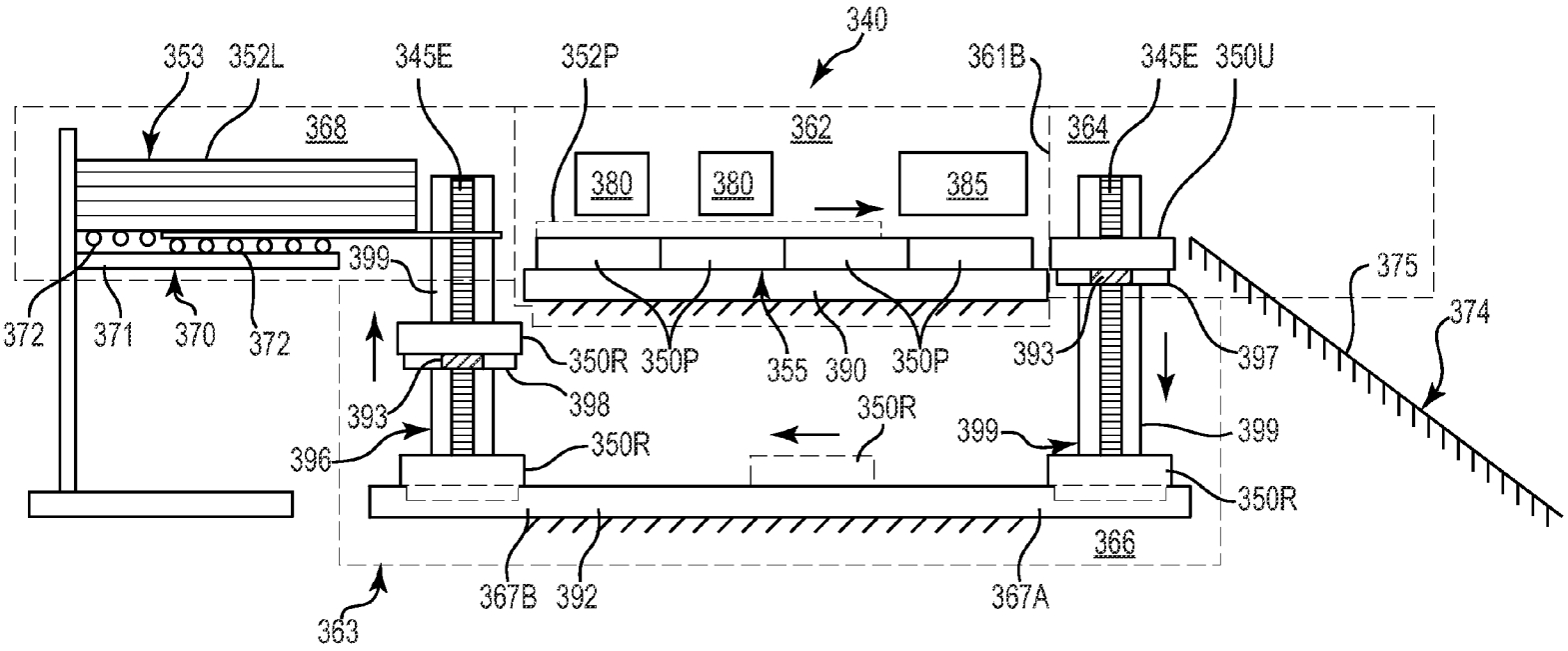
FIG. 7 is a side view schematically illustrating a media transport assembly with a media in a first transport position across a print zone, according to an embodiment of the present disclosure.
Figure 8:
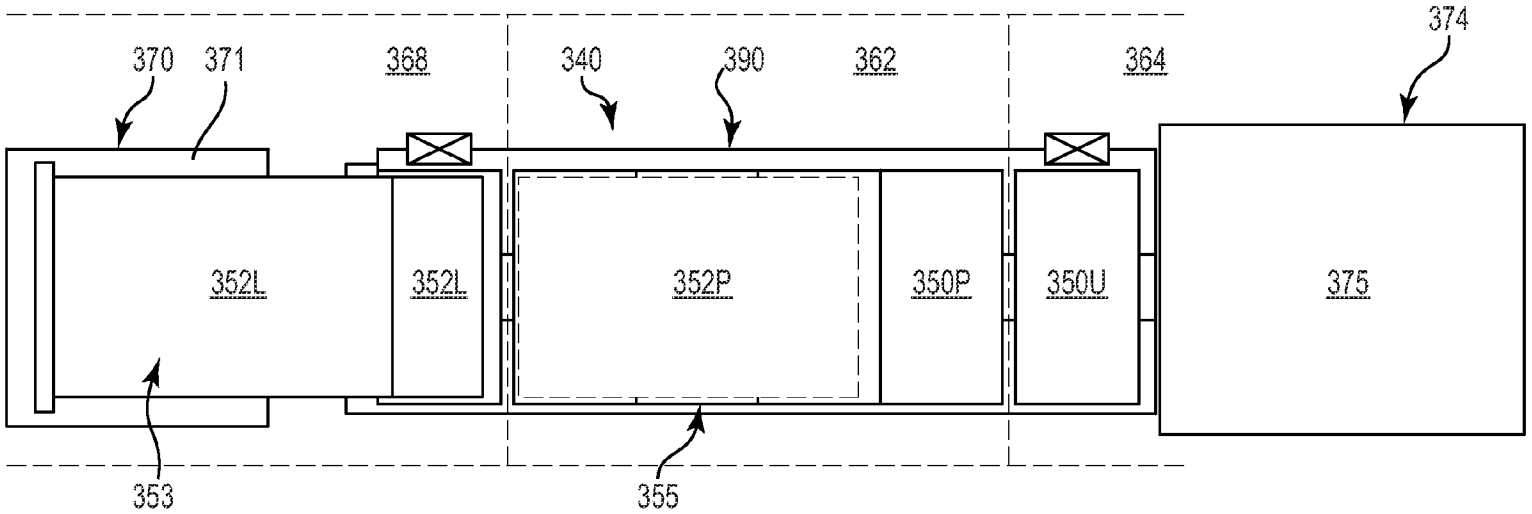
FIG. 8 is a partial top view schematically illustrating the media transport assembly of FIG. 7, according to an embodiment of the present disclosure.

FIG. 7 is a side view similar to FIG. 3, except depicting a print media 352P within print zone 362 underneath printhead assemblies 380 just after a print media 352P is released from loading mechanism 370. FIG. 8 is a top view of the media transport assembly 340 of FIG. 7 (with printhead assemblies 380 and controller 385 removed for illustrative clarity) in accordance with one embodiment of the present disclosure. As shown in FIGS. 7-8, print media 352P is supported by group 355 of pallets 350P, which in this example includes three pallets 350P. As further shown in FIGS. 7 and 8, at the same time, loading mechanism 370 is beginning to advance a single print media 352L from stack 353 of print media 352L toward print zone 362 by causing a first portion of print media 352L to extend outward over the path of platform 398 (with a pallet 350L thereon) of second elevator 396. In this position, upon contact of platform 398 and pallet 350L with and underneath print media 352L, and in cooperation with rollers 372 of loading mechanism 370, print media 352L will be positioned for advancement onto the next temporary group of pallets 350P in print zone 362. As shown in FIG. 7, platform 398 of second elevator 396 is moving upward toward the loading portion 368 of handling zone 363 to engage the next print media 352L. In addition, at the opposite end of print zone 362, platform 397 of first elevator 394 is interposed between second end 361B of print zone 362 and ramp 375 of unloading mechanism 374, and thereby positioned to receive a printed-upon print media 352P that exits the print zone 362.

Figure 9:
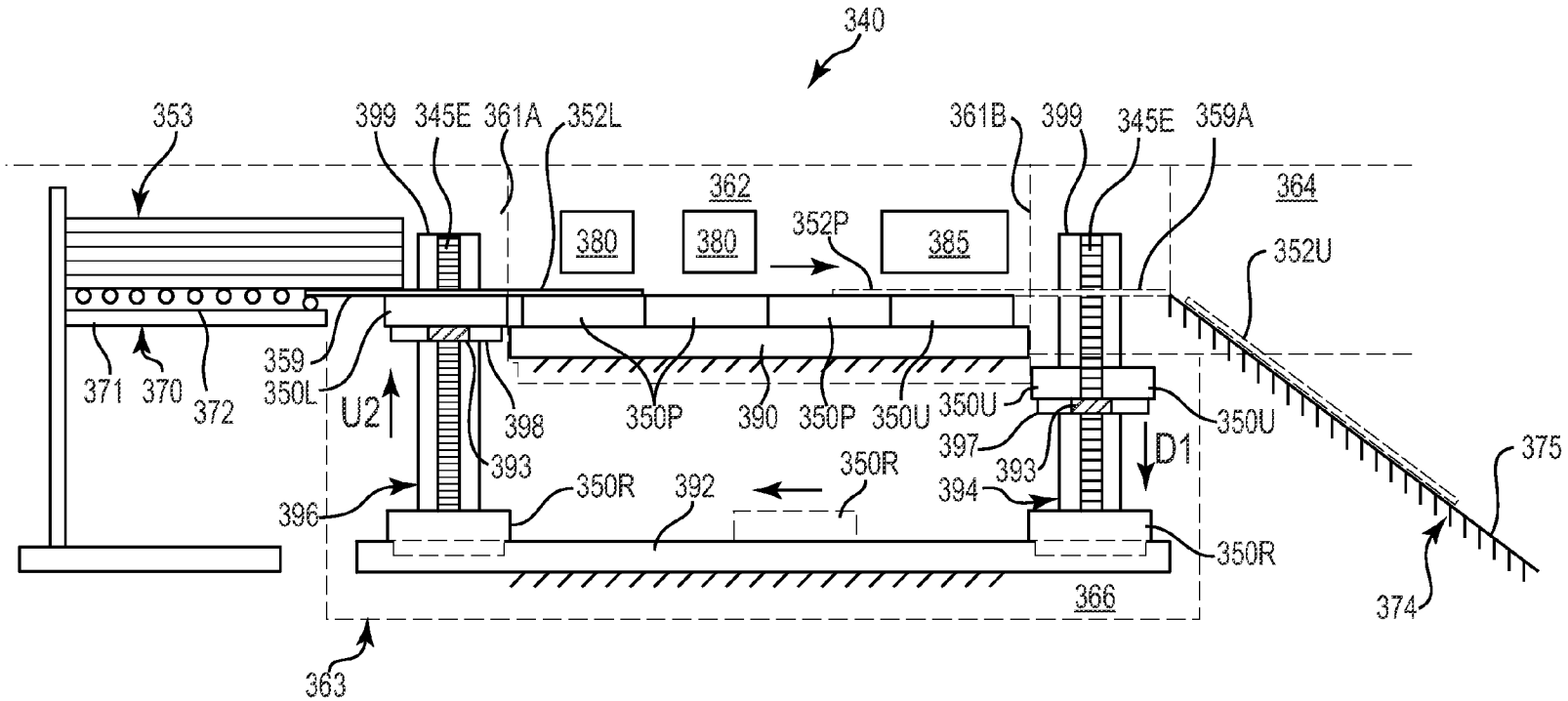
FIG. 9 is a side view schematically illustrating a media transport assembly with a media in a second transport position across a print zone, according to an embodiment of the present disclosure.
Figure 10:
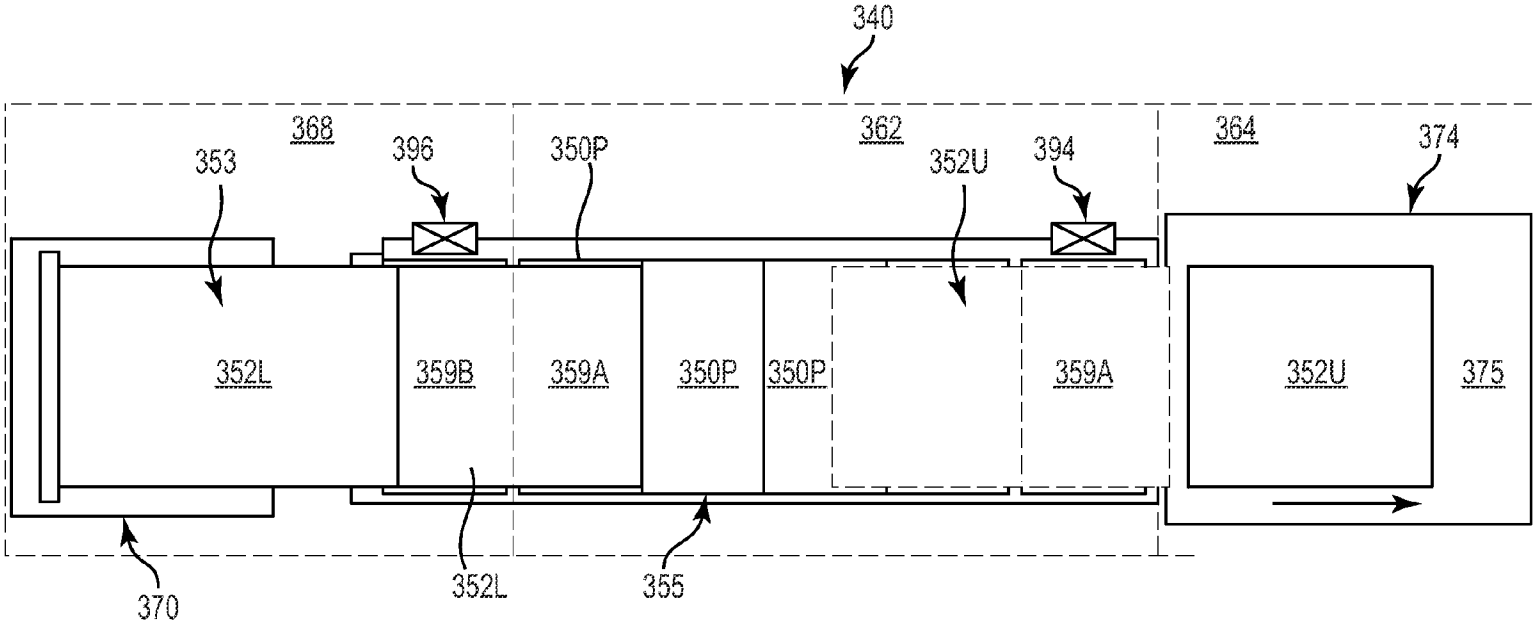
FIG. 10 is a partial top view schematically illustrating the media transport assembly of FIG. 9, according to an embodiment of the present disclosure.

FIG. 9 is a side view similar to FIGS. 3 and 7, except depicting a print media 352P beginning to exit print zone 362 beyond printhead assemblies 380 and as the print media 352P enters unloading mechanism 374. FIG. 10 is a top view of the media transport assembly of FIG. 9 (with printhead assemblies 380 and controller 385 omitted for illustrative clarity), in accordance with one embodiment of the present disclosure. With print media 352U having been just released onto ramp 375 of unloading mechanism 374 as shown in FIG. 10, platform 397 of first elevator 394 descends vertically downward (as represented by directional arrow D1) toward return portion 366 of handling zone 363 as shown in FIG. 9. At the same time, just printed-upon print media 352P is supported by pallets 350P with a first portion 359A of print media 352P extending freely (without direct support) toward unloading mechanism 374 as shown in both FIGS. 9 and 10. Upon return of platform 397 of first elevator 394 (after releasing pallet 350R at return portion 366) to unloading portion 364, platform 397 of first elevator 394 supportingly engages first portion 359A of print media 352U to assist and complete transfer of print media 352U from print zone 362 to unloading mechanism 374. Once platform 397 of first elevator 394 is in place between ramp 375 and the second end 361B of print zone 362, the LM unit 345U on platform 397 of first elevator 394 (see FIGS. 4-5) acts to cause further movement of print media 352U toward and onto ramp 375 of unloading mechanism 374 (or onto other unloading components such as a platform like platform 75 in FIG. 2A).

As one print media 352U is exiting print zone 362, at the other opposite end 361A of the print zone 362, another blank print media 352L is being advanced onto a temporary group 355 of pallets 350P. As shown in FIGS. 9-10, a first portion 359A of print media 352L is supported on a first pallet 350P (supported by track/frame) within print zone 362 while a second portion 359B of print media 352L is supported on a second pallet 350L (supported by platform 398 of second elevator 396) and a third portion 359C of print media 352L (best seen in FIG. 9) is exiting platform 371 of loading mechanism 370 with the advancement of print media 352L. In this position, as the action of loading mechanism 370 begins to wane from advancing print media 352L, the LM unit 345L of platform 398 of second elevator 396 causes movement of print media 352L across platform 398 toward print zone 362. In some embodiments, the LM unit 345L continues to cause forward movement of print media 352L until at least the first and second portions 359A, 359B of the print media 352L are fully supported by the pallets 350P within print zone 362. In any case, once print media 352L is sufficiently supported by pallets 350P in print zone 362, platform 398 of second elevator 394 begins its vertical descent to return portion 366 to retrieve the next available pallet 350R.

Figure 11:
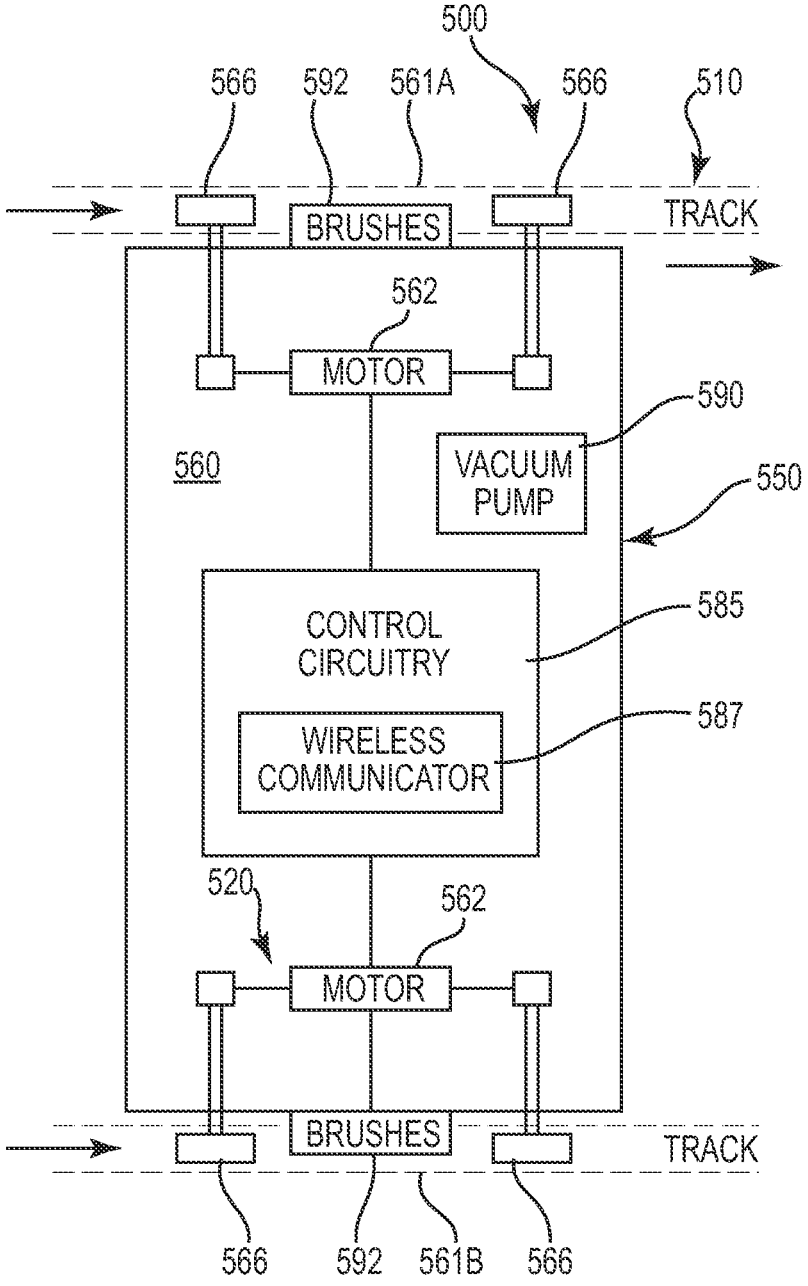
FIG. 11 is a top view schematically illustrating a self-propelled pallet of a media transport assembly, according to an embodiment of the present disclosure.

FIG. 11 is top view schematically illustrating a pallet 550 of a media transport assembly 500, according to one embodiment of the present disclosure. In one embodiment, pallet 550 and track 510 forms part of media transport assembly 500 having substantially the same features and attributes as the media transport assemblies as previously described in association with FIGS. 1-10, except each pallet having an independent self-propulsion mechanism 520 instead of being driven by LM units (such as LM units 45, 345). In this arrangement, a track 510 is passive in the sense that no portion associated with the track 510 includes components to drive and control the position (along the track) and movement of the pallets 550. Instead, each pallet 550 includes its own propulsion mechanism to render independent control of movement and position of the respective pallet 550 relative to the track 510.

As shown in FIG. 11, pallet 550 includes a frame 560 and self-propulsion mechanism 520, which includes at least motors 562, wheels 566, and control circuitry 585. Frame 560 supports wheels 566 on opposite sides 561A, 561B of frame while motors 562 act to provide controlled motion to wheels 566 relative to track 510, via control circuitry 585, thereby controlling the position and movement of pallet 550 relative to track 510. In one embodiment, control circuitry 585 is in communication with control circuitry 585 of other pallets 550 along track 510 and/or in communication with a master controller (such as controller 385 in FIG. 3) that coordinates the position and movement of the pallets 550 along the track 510. In one embodiment, control circuitry 585 includes a wireless communicator module 587 configured to enable wireless communication with control circuitry 585 of other pallets 550 or of the master controller. In some embodiments, each pallet 550 includes its own vacuum mechanism including a vacuum surface portion and vacuum pump 590, in a manner substantially the same as previously described in association with FIG. 6A. In some embodiments, pallet 550 includes conductive brushes 592 positioned to contact a conductive component of track 510 to receive power for operating the components of pallet 550 without having a wired connection between pallet 550 and other components of track 510 and/or media transport assembly 500.

Figure 12:
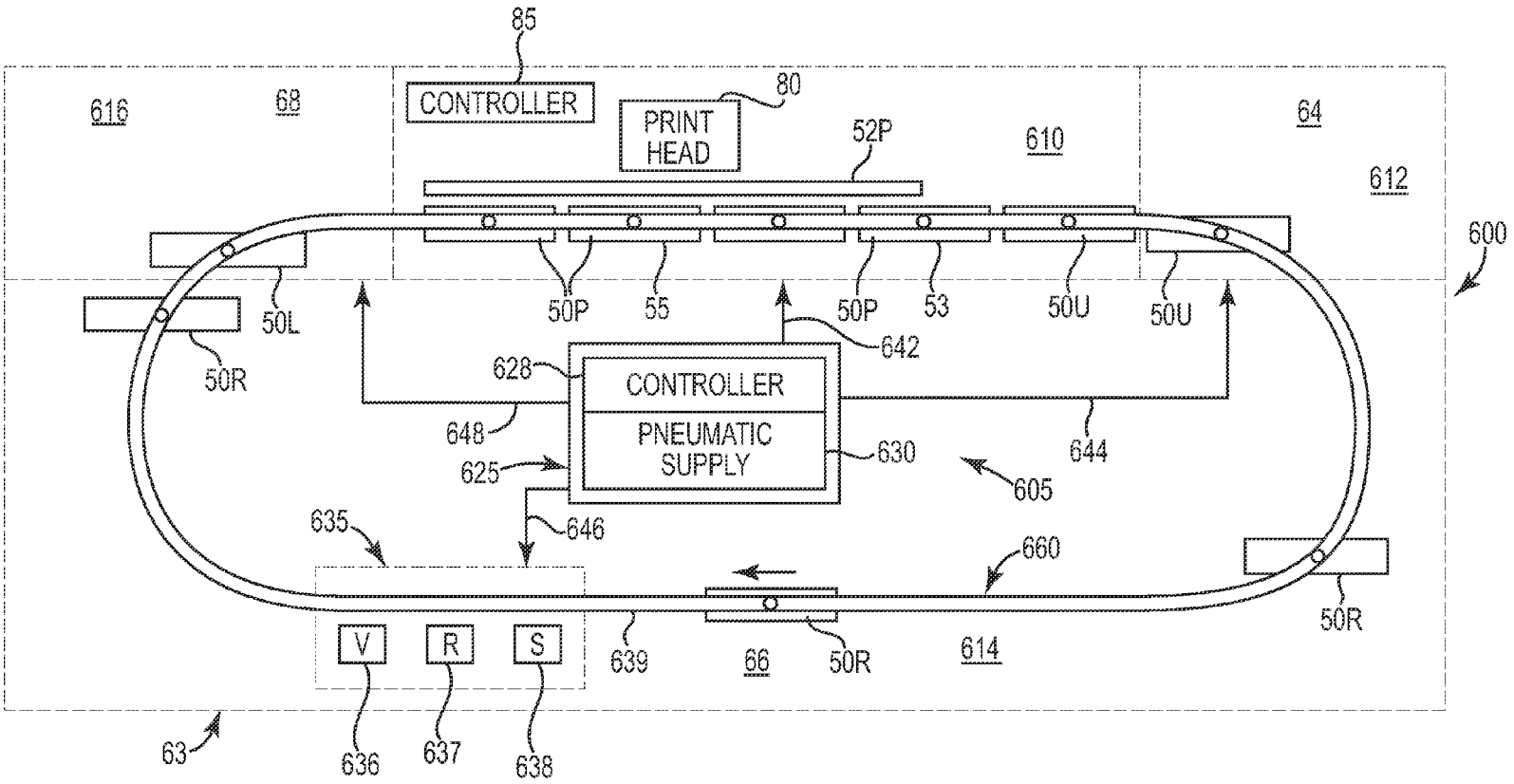
FIG. 12 is a side view schematically illustrating a media transport assembly of a printer, according to an embodiment of the present disclosure, including a pneumatic control system.

FIG. 12 is a side view schematically illustrating a media transport assembly 600, according to an embodiment of the present disclosure. In one embodiment, media transport assembly 600 includes substantially the same features as media transport assemblies 40, 100 (as previously described in association with at least FIGS. 2A-2B), except having a pneumatically controlled conveying system 605 to move pallets 50 along a track 660 while controlling the position and velocity of each pallet individually. As such, media transport assembly 600 provides just one example of a mechanism configured to control pallets 50 in accordance with the principles of the present disclosure but without employing linear motors (e.g. LM units 45 in FIG. 2B).

As shown in FIG. 12, among other features media transport assembly 600 comprises a pneumatic conveying system 605, which includes a control module 625 configured to control the velocity of pallets 50 through a sequence of controls zones around a track 660. As shown in FIG. 12, each pallet 50 is rotatably or rollingly supported on track 660 via one or more rollers or pins 661 on each pallet. In manner similar to the arrangement shown in FIG. 2F, rollers or pins 661 travel along rails of track 660.

In one aspect, pneumatic control system 605 includes a first control zone 610 generally coextensive with print zone 62, a second control zone 612 generally coextensive with unloading portion 64 of handling zone 63, a third control zone 614 generally coextensive with return portion 66 of handling zone 63, and a fourth control zone 616 generally coextensive with loading portion 68 of handling zone 63.

In one embodiment, the control module 625 includes a controller 628 and a pneumatic supply 630. In some embodiments, controller 628 is separate from controller 85, while in other embodiments, controller 85 cooperates with or acts as controller 628. The control module 625 is in electrical communication and fluid (air) communication with each control zone 610, 612, 614, 616 via lines 642, 644, 646, 648, respectively, to exert signal control over a pneumatic control support assembly 635 in each control zone while also supplying air. It will be understood that FIG. 12 schematically depicts just one such pneumatic control support assembly 635 (in zone 614) for illustrative clarity although it will be understood that each control zone 610, 612, 614, 616 includes one or more pneumatic control support assemblies 635.

Figure 13:
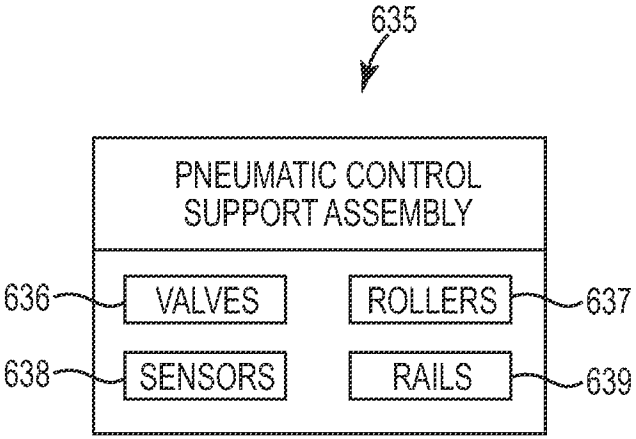
FIG. 13 is a block diagram of a pneumatic control support assembly, according to an embodiment of the present disclosure.

As shown in both FIGS. 12-13, each pneumatic control support assembly 635 is configured to control a position and a velocity of one or more pallets 50 through a respective control zone along track 660. In one embodiment, each pneumatic control support assembly 635 includes a combination of elements, including but not limited to, valves 636, rollers 637, sensors 638, and rails 639 which cooperate together in a manner familiar to those skilled in the art (under direction from controller 628) to interact with each pallet 50 to control both a position and movement of the pallets 50 along track 660. In one aspect, the rollers 637 arranged along the length of track 660 act individually and/or collectively to releasably engage and disengage components of the pallets 50 selectively, depending upon the position of the pallet 50 along track 660 (which is sensed via sensors 638), to exert control over the velocity of the pallets 50. Valves 636 provide control over pneumatic actuation of the various components. In one embodiment, pneumatic control support assembly 635 includes features that correspond generally to those found in U.S. Pat. Nos. 4,383,605 and 4,264,004 issued to Harwick.

Because each control zone 610, 612, 614, 616 is equipped via a pneumatic control support assembly 635, each respective zone is configured to control the position and the velocity of pallet(s) 50 independently from the other zones. Accordingly, first zone 610 operates to cause movement of pallets 50 at a first velocity that is substantially constant as pallets 50P support a print media during printing while also causing the respective pallets 50P to be positioned immediately adjacent to each other in a group to form a moving virtual table that supports the print media (in a manner substantially similar as previously described in association with FIGS. 1-11). In one embodiment, pneumatic control support assembly 635 in first control zone 610 is arranged to cause the pallets 50 to become automatically and temporarily grouped together along track 660 in the print zone 62. In the third control zone 614, one or more pneumatic control support assemblies 635 causes pallets 50R to be spaced apart from each other and to move at a velocity substantially greater than the velocity in the print zone in order to expedite return of empty pallet(s) 50R back to the print zone 62.

Similar, the second zone 612 (corresponding to unloading portion 64 of handling zone 63) includes one or more pneumatic control support assemblies 635 that are configured to cause pallets 50U to begin becoming spaced part from the grouped pallets in first zone 610 (also known as print zone 62) to facilitate unloading of printed-upon print media 52 from pallet(s) 50U and to cause the emptied pallets 50U to transition from their slower travel in the print zone 62 to their faster travel in the return portion 63. Moreover, the fourth zone 616 (corresponding to loading portion 68 of handling zone 63) includes one or more pneumatic control support assemblies 635 that are configured to cause pallets 50L to begin becoming grouped together with the pallets 50P that are already in the first zone 610 (also known as print zone 62) while also facilitating loading of fresh print media 52 onto pallet(s) 50L. It will be further understood that, in some embodiments, control module 625 will cause pallets 50 traveling through the second and fourth zones 612, 616 to have variable speeds, as the pallets 50 transition repeatedly between the generally lower velocity of the first zone 610 (also print zone 62) and the generally higher velocity of the third zone 614 (also return portion 66 of handling zone 63).

With this arrangement in mind, it will be further understood that principles of the present disclosure contemplate other embodiments that include the use of other types of propulsion and motion control arrangements which cause pallets along an endless path to move independently from each other, while causing temporary aggregation of the pallets in a group to form a virtual table to support a print media through a print zone. With such an arrangement, friction is greatly reduced while transporting a print media during printing while also minimizing the cost of the transport mechanism. Such arrangements also control the pallets to be spaced apart from each other when traveling along portions of the path outside a print zone, further reducing friction and aiding in the overall speed of the media transport assembly.

Embodiments of the present disclosure provide media transport assemblies having low-friction, mechanically efficient mechanisms to move a print media at a desired velocity through a print zone while avoiding costly or complicated conventional conveying systems sometimes associated with conventional methods to support and move a print media in large scale printers.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A printing system comprising:
a plurality of pallets;
an endless track on which the pallets circulate through:
a print zone wherein some of the pallets temporarily form a group in a position immediately adjacent each other and wherein the group supports and moves a print media, wherein each pallet is smaller than the print media; and
a handling zone wherein the other respective pallets are moved along the track and return to the print zone; and
a printing mechanism positioned in the print zone and configured to print onto the print media carried by the at least some pallets in the print zone.

2. The printing system of claim 1, wherein the handling zone includes:
a loading zone configured to load, prior to the print zone, the print media onto a respective one of the circulating pallets;
an unloading zone configured to unload, after the print zone, the print media off a respective one of the circulating pallets; and
a return zone configured to transport the pallets along the track from the unloading zone to the loading zone.

3. The printing system of claim 2, wherein the handling zone comprises:
a first elevator positioned between the return zone and the loading zone, and configured to move the pallets, one-by-one, from the return zone vertically upward to the loading zone; and
a second elevator positioned between the unloading zone and the return zone, and configured to move the pallets, one-by-one, from the unloading zone vertically downward to the return zone.

4. The printing system of claim 1, comprising:
a controller configured to individually control a velocity of each pallet along the track.

5. The printing system of claim 4, wherein the pallets and the track are operably coupled together via:
a first portion disposed along a length of the track; and
a plurality of second portions, with a respective one of the second portions disposed on each respective pallet,
wherein one of the respective first and second portions comprise an electromagnetic element and the other of the respective first and second portions comprise a magnetically responsive material, and
wherein the controller is configured to electromagnetically control the velocity of the pallets relative to the track.

6. The system of claim 4, wherein each pallet includes:
a self-propulsion mechanism in communication with the controller and configured to selectively cause movement of the pallet relative to the track and independent of the other pallets.

7. The printing system of claim 4, wherein the controller is configured to cause the group of pallets to move at a first substantially constant velocity in the print zone and to move at a second velocity in at least one portion of the handling zone, wherein the second velocity is substantially higher than the first velocity.

8. The printing system of claim 1, wherein each pallet includes a vacuum mechanism configured to selectively apply a vacuum at a top portion of the pallet to removably secure print media relative to top portion of the pallet.

9. The printing system of claim 1, wherein the temporary group of some pallets in the print zone defines a virtual table and wherein a size of the virtual table is selectable according to a size of the image to be printed.

10. A printing system comprising:
a plurality of pallets;
an endless track on which the pallets circulate through:
a print zone wherein some of the pallets temporarily form a group in a position immediately adjacent each other, wherein the group supports and moves a print media, and wherein each pallet is smaller than the print media; and
a handling zone wherein the other respective pallets are moved along the track and return to the print zone,
a controller configured to individually control a velocity of each pallet along the track; and
a pneumatically controlled conveying assembly in electrical communication with the controller and configured to control a position and velocity of each pallet independently along the track.

11. A printing system comprising:
a plurality of pallets; and
an endless track on which the pallets circulate through:
a print zone in which some of the pallets are immediately adjacent each other to temporarily form a group that supports and moves print media; and
a handling zone in which the pallets move without supporting a print media;
wherein the track includes:
a support structure to enable movement of the pallets relative to the track; and
a drive mechanism extending generally parallel with the support structure to control a position and movement of each pallet,
a controller configured to individually control a velocity of each pallet along the track, wherein the controller is configured to cause the group of pallets to move at a first substantially constant velocity in the print zone and to move at a second velocity in at least a return portion of the handling zone, wherein the second velocity is substantially higher than the first velocity.

12. A method of transporting print media sheets, the method comprising:
grouping together a plurality of sheet-supporting pallets at or before a print zone;
carrying a single print media sheet through the print zone on the group of pallets;
ungrouping the pallets; and
repeatedly performing the acts of grouping, carrying and ungrouping throughout a printing operation.

13. The method of claim 12, wherein grouping together the plurality of pallets comprises:
selecting a size of a virtual table formed by the group of pallets according to a size of an image to be printed upon the print media sheet.

* * * * *

UNITED STATES PATENT AND TRADEMARK OFFICE

CERTIFICATE OF CORRECTION

PATENT NO. : 9,067,408 B2
APPLICATION NO. : 13/699171
DATED : June 30, 2015
INVENTOR(S) : Alex Veis It is certified that error appears in the above-identified patent and that said Letters Patent is hereby corrected as shown below:

In the Claims

In column 17, line 62 approx., in Claim 6, delete "The system of" and insert -- The printing system of --, therefor.

Signed and Sealed this
Twenty-sixth Day of April, 2016

Michelle K. Lee

Michelle K. Lee
*Director of the United States Patent and Trademark Office*